US006116196A

United States Patent [19]

Watanabe et al.

[11] Patent Number: 6,116,196

[45] **Date of Patent: *Sep. 12, 2000**

[54] WATER-TUBE BOILER

[75] Inventors: Shigehiro Watanabe; Noboru Takubo; Kanta Kondou, all of Matsuyama, Japan

[73] Assignees: Miura Co., Ltd.; Miura Institute of Research & Development Co., Ltd., both of Ehime-Ken, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/903,418

[22] Filed: Jul. 30, 1997

[30] Foreign Application Priority Data

Feb. 28, 1997 [JP] Japan ..... 9-062149
Feb. 28, 1997 [JP] Japan ..... 9-062150

[51] Int. Cl.[7] ..... F22B 21/00

[52] U.S. Cl. ..... 122/235.11; 122/235.23; 122/367.1; 122/6 A

[58] Field of Search ..... 122/367.1, 367.2, 122/367.3, 7 R, 6 A, 13.1, 235.11, 235.32

[56] References Cited

U.S. PATENT DOCUMENTS

| | | | |
|---|---|---|---|
| 3,169,512 | 2/1965 | Hochmuth | 122/7 R |
| 3,633,550 | 1/1972 | Kraus | 122/235.11 |
| 3,793,994 | 2/1974 | Olsen | 122/52 |
| 4,257,358 | 3/1981 | Watanabe | 122/235.11 |
| 4,270,493 | 6/1981 | Blaskowski | 122/7 R |
| 4,377,132 | 3/1983 | Koog et al. | 122/7 R |
| 4,453,496 | 6/1984 | Yoshinari | 122/6 A |
| 4,513,694 | 4/1985 | Wiemer | 122/7 R |
| 4,550,769 | 11/1985 | Bhojwani et al. | 122/7 R |
| 4,707,991 | 11/1987 | Firey | 60/670 |
| 4,825,813 | 5/1989 | Yoshinari et al. | 122/6 A |
| 5,020,479 | 6/1991 | Suesada et al. . | |
| 5,199,384 | 4/1993 | Kayahara et al. . | |
| 5,273,001 | 12/1993 | Kayahara et al. . | |
| 5,353,748 | 10/1994 | Kayahara et al. . | |

FOREIGN PATENT DOCUMENTS 60-78247 5/1985 Japan .

*Primary Examiner*—Denise L. Ferensic
*Assistant Examiner*—Jiping Lu

[57] ABSTRACT

In a water-tube boiler in which pollutant (especially NOx) emissions are reduced, a plurality of water tubes arranged in an annular shape are provided. At least some of the water tubes thereof are spaced apart along an annulus so as to provide a plurality of gaps therebetween. A combustion-reaction ongoing gas passes through these gaps, and a temperature thereof is lowered to 1400° C. upon contact with the water tubes. The boiler further includes a second plurality of water tubes arranged in an annular shape outside of the first plurality of water tubes. By adjusting the arrangement of the water tubes along respective annuli and/or adjusting an orientation of the tubes along their length (so as to be straight, tilted, or bent), control of the exhaust emissions is enhanced.

41 Claims, 11 Drawing Sheets

WATER-TUBE BOILER

BACKGROUND OF THE INVENTION

The present invention relates to water-tube boilers such as once-through boilers, natural circulation water-tube boilers and forced circulation water-tube boilers.

The water-tube boiler is a boiler the body of which is made up by water tubes. The body arrangement of such a water-tube boiler is, for example, that a plurality of water tubes are arranged into an annular shape. In the water-tube boiler of this form, a cylindrical space surrounded by the annular water tube array is used as a combustion chamber. In such a water-tube boiler, heat transfer primarily by radiation is performed within the combustion chamber, and then heat transfer primarily by convection is done in the downstream of the combustion chamber.

In recent years, such water-tube boilers are also desired to be further reduced in $NO_x$ and CO. The reduction in $NO_x$, as it stands now, is implemented by fitting low-$NO_x$ burners or exhaust-gas re-circulation equipment to the existing boiler bodies. The reduction in CO is implemented by adjusting the state of combustion of the combustion equipment.

SUMMARY OF THE INVENTION

An object of the present invention is to achieve the reduction in $NO_x$, with a simple construction of the water-tube boiler, and to achieve reduction in both $NO_x$ and CO at the same time with a simple construction.

The present invention having been accomplished to solve the foregoing problems, first with a view to fulfilling the reduction in $NO_x$, there is provided a water-tube boiler characterized in that a plurality of water tubes are arranged in a zone where burning-reaction ongoing gas is present within a combustion chamber. The water-tube boiler is also characterized in that: the plurality of water tubes are arranged within the combustion chamber so that temperature of the burning-reaction (otherwise known as "combustion-reaction") ongoing gas after making contact with the water tubes will be below 1400° C.; that gaps which permit the burning-reaction ongoing gas to flow therethrough are formed between adjacent water tubes; that part of the plurality of water tubes are arranged so as to be gathered in close contact; that the plurality of water tubes are arranged so as to include different widths of the gaps; that the plurality of water tubes are arranged into an annular shape of two or more arrays; that the plurality of water tubes are tilted tubes or bent tubes; and that heat-recovery water tubes are arranged outside the water tubes arranged into an annular shape.

Further with a view to fulfilling the reduction in $NO_x$ and the reduction in CO at the same time, there is provided a water-tube boiler characterized in that the water-tube boiler comprises: a first water tube array formed by arranging a plurality of water tubes into an annular shape in a zone where burning-reaction ongoing gas is present within a combustion chamber; gaps provided between adjacent water tubes of the first water tube array so as to permit the burning-reaction ongoing gas to flow therethrough; and a zone provided around the first water tube array to allow burning reaction to be continuously effected. The water-tube boiler is also characterized in that: the plurality of water tubes are arranged within the combustion chamber so that temperature of the burning-reaction ongoing gas after making contact with the water tubes will be below 1400° C.; that the first water tube array is an annular water tube array of two or more arrays; that a plurality of heat-recovery water tubes are arranged outside the first water tube array; that part of the plurality of heat-recovery water tubes are arranged so as to be gathered in close contact; that the plurality of heat-recovery water tubes are arranged so as to include different widths of gaps between adjacent heat-recovery water tubes; that the plurality of heat-recovery water tubes form an annular second water tube array; that the second water tube array is an annular water tube array of two or more arrays; and that the second water tube array has an inner-array opening provided at a portion of its inner array and communicating inner circumferential side and outer circumferential side of the inner array with each other, and an outer-array opening provided at a portion of its outer array and communicating inner circumferential side and outer circumferential side of the outer array with each other, wherein the inner-array opening and the outer-array opening are arranged so as to be shifted circumferentially of the second water tube array.

The present invention is embodied as a water-tube boiler of the multiple-tube type. Further, the water-tube boiler of the present invention is applied not only as steam boilers or hot water boilers, but also as heat medium boilers in which a heat medium is heated.

Referring first to the invention for designing the implementation of the reduction in $NO_x$, the water-tube boiler in the first aspect of the invention is characterized in that a plurality of water tubes are arranged into an annular shape in a zone where burning-reaction ongoing gas is present within a combustion chamber (hereinafter, referred to as "burning reaction zone"). The combustion chamber is so formed that part or entirety of its interior serves as a space for burning reaction, where the space is defined by water tube arrays in one case or by exterior walls formed of refractory materials in another case. The burning-reaction ongoing gas refers to a high-temperature gas during the process that burning reaction is taking place in the combustion chamber. The burning reaction zone is preferably a zone where a flame is taking place in the burning-reaction ongoing gas, or a zone where a high-temperature burning-reaction ongoing gas is present with the temperature of the burning-reaction ongoing gas above 900° C. The flame herein referred to is a phenomenon that occurs to burning-reaction ongoing gas that is in the course of a vigorous burning reaction. This flame may be visually discerned in some cases or may be different to visually discern or impossible to visually discern in other cases.

Therefore, in the water-tube boiler according to the first aspect of the invention, by arranging a plurality of water tubes in the burning reaction zone, the burning-reaction ongoing gas is cooled by the plurality of water tubes so that the temperature is lowered, by which the generation of thermal $NO_x$ is suppressed. The reason of this is that, as explained in the Zeldovich mechanism, the more the temperature of burning reaction is high, the more the thermal $NO_x$ is accelerated in its generation rate with its generation amount increasing; that is, the more the temperature of burning reaction is low, the more the thermal $NO_x$ is decelerated in its generation rate with its generation amount decreasing. Especially when the temperature of burning reaction is under 1400° C., the generation rate of the thermal $NO_x$ is remarkably retarded. Then, according to the first aspect of the invention, in which a plurality of water tubes are arranged into an annular shape, because the burning-reaction ongoing gas performs heat transfer upon contact with the individual water tubes, thermal load can be generally uniformed. Further, because the burning-reaction ongoing gas is cooled by the individual water tubes, the effect of reducing $NO_x$ is also conducted generally uniformly on the entire circumference of the annular water tube array.

Also, in the first aspect of the invention, in which a plurality of water tubes are arranged into an annular shape, the annular arrangement may be such that the plurality of water tubes may be arranged into a circular shape, or into an elliptical shape. Otherwise, the plurality of water tubes may be arranged into triangular, quadrangular or higher polygonal shapes. Furthermore, for the arrangement of the plurality of water tubes into an annular shape, the water tubes may be arranged in such a way that the lines connecting center to center of the water tubes form projections and recesses.

In the second aspect of the invention, the plurality of water tubes are arranged within the combustion chamber so that temperature of the burning-reaction ongoing gas after making contact with the water tubes will be below 1400° C. With this arrangement, the temperature of the burning-reaction ongoing gas lowers so that the generation of thermal $NO_x$ is lessened and therefore that the reduction in $NO_x$ for the water-tube boiler can be achieved.

In the third aspect of the invention, gaps which permit the burning-reaction ongoing gas to flow therethrough are formed between adjacent water tubes. Each of these gaps has such a width that the burning-reaction ongoing gas passing through these gaps will keep burning reaction even if cooled by the water tubes, where the width needs to be at least 1 mm.

In the fourth aspect of the invention, part of the plurality of water tubes are arranged so as to be gathered in close contact. With such an arrangement, the state of contact between the water tubes and the burning-reaction ongoing gas can be adjusted so that the amount of heat transfer can be adjusted.

In the fifth aspect of the invention, the plurality of water tubes are arranged so as to include different widths of the gaps. That is, the plurality of water tubes are arranged into an annular shape so that wider gaps and narrower gaps are provided. With this arrangement, the state of contact between the water tubes and the burning-reaction ongoing gas can be adjusted so that the amount of heat transfer can be adjusted.

In the sixth aspect of the invention, the plurality of water tubes are arranged into an annular shape of two or more arrays. With this arrangement of the plurality of water tubes, the amount of heat transfer with the burning-reaction ongoing gas can be increased so that the temperature of the burning-reaction ongoing gas can be further lowered, and therefore that the generation of thermal $NO_x$ is lessened to a large extent. In this case, the arrangement is preferably such that the water tubes of the outer array are positioned between adjacent water tubes of the inner array.

In the seventh aspect of the invention, the plurality of water tubes are tilted tubes or bent tubes. The tilted tubes herein referred to are water tubes tilted on the whole, while the bent tubes are water tubes having bent portions or curved portions. When a plurality of water tubes are provided by tilted tubes or bent tubes as in this case, even more burning-reaction ongoing gas can be put into contact with the individual water tubes, so that the burning-reaction ongoing gas can be effectively cooled and that the reduction in $NO_x$ can be achieved. Also, in the seventh aspect of the invention, the plurality of water tubes do no have to be all tilted tubes or bent tubes, but it is appropriate that part of the plurality of water tubes are at least either tilted tubes or bent tubes. The bent tubes may be of either case where they have either one of bent portions or curved portions, or where they have both of them. Further, the bent tubes are not necessarily bent or curved at one place. Furthermore, the bent tubes may be curved on the whole.

In the eighth aspect of the invention, heat-recovery water tubes are arranged outside the water tubes arranged into an annular shape. These heat-recovery water tubes perform further heat recovery from the burning-reaction ongoing gas that has passed through the gaps between the water tubes as well as a gas that has completed the burning reaction (hereinafter, referred to as "burning-reaction completed gas"), so that the efficiency of the water-tube boiler is enhanced.

Referring next to the invention for designing the simultaneous implementation of $NO_x$ reduction and CO reduction, the water-tube boiler in the ninth aspect of the invention comprises: a first water tube array formed by arranging a plurality of water tubes into an annular shape in a zone where burning-reaction ongoing gas is present within a combustion chamber (hereinafter, referred to as "burning reaction zone" as in the foregoing case); and gaps provided between adjacent water tubes of the first water tube array so as to permit the burning-reaction ongoing gas to flow therethrough. The combustion chamber, the burning-reaction ongoing gas and the burning reaction zone herein referred to are of the same meanings as in the description of the first aspect, and the case is the same also with the flame.

In the ninth aspect of the invention, by arranging a plurality of water tubes in the burning reaction zone, the burning-reaction ongoing gas is cooled by the plurality of water tubes so that the temperature is lowered, by which the generation of thermal $NO_x$ is suppressed. During this process, the burning-reaction ongoing gas flows through the gaps between the water tubes, so that the $NO_x$ reduction effect due to the cooling is enhanced. The reason of this is as explained in the Zeldovich mechanism, as has been described for the first aspect. Then, in the ninth aspect of the invention, a zone is provided around the first water tube array to allow burning reaction to be continuously effected (hereinafter, referred to as "burning-reaction continuing zone"). This burning reaction continuing zone is a zone where, after the burning reaction inside the first water tube array, intermediate products of burning reaction such as CO and HC as well as unburnt components of the fuel are subjected to burning reaction. The burning-reaction ongoing gas will flow into this burning-reaction continuing zone through the gaps. Because CO remaining in the burning-reaction ongoing gas will be oxidized into $O_2$ during the flow in the burning-reaction continuing zone, the discharge amount of CO from the water-tube boiler is lessened. Then, according to the ninth aspect of the invention, in which a plurality of water tubes are arranged into an annular shape, because the burning-reaction ongoing gas performs heat transfer upon contact with the individual water tubes, thermal load can be generally uniformed. Further, because the burning-reaction ongoing gas is cooled by the individual water tubes, the effect of reducing $NO_x$ is also conducted generally uniformly on the entire circumference of the first water tube array. In this case, the annular arrangement of the plurality of water tubes may be circular, elliptical, polygonal shapes, as described for the first aspect, moreover the arrangement may be such that the lines connecting center to center of the water tubes form projections and recesses.

In the ninth aspect of the invention, in which gaps are provided between adjacent water tubes so as to permit the burning-reaction ongoing gas to flow therethrough, each of these gaps has such a width that the burning-reaction ongoing gas passing through these gaps will keep burning reaction even if cooled by the water tubes, where the width needs to be at least 1 mm. Then, the gaps do not need to be formed every adjacent water tubes; instead, for example, the plurality of water tubes may be arranged so that a specified number of water tubes are gathered in close contact, and that gaps are provided between one group of such closely gathered water tubes and another. Further, the gaps do not need to be all of the same width, but the plurality of water tubes may be arranged into an annular shape so that wider gaps and narrower gaps are provided.

In the tenth aspect of the invention, as in the second aspect of the invention, the reduction in $NO_x$ for the water-tube boiler can be achieved.

In the eleventh aspect of the invention, the first water tube array is an annular water tube array of two or more arrays. Because the amount of heat transfer with the burning-reaction ongoing gas can be increased so that the temperature of the burning-reaction ongoing gas can be further lowered, and therefore that the generation of thermal $NO_x$ is lessened to a large extent. Also, by arranging the first water tube array into an annular water tube array of two or more arrays, the efficiency of the water-tube boiler can be enhanced. In this case, the arrangement is preferably such that the water tubes of the outer array are positioned between adjacent water tubes of the inner array.

In the twelfth aspect of the invention, a plurality of heat-recovery water tubes are arranged outside the first water tube array. Within the burning-reaction continuing zone located outside the first water tube array, the burning-reaction ongoing gas has generated heat due to the continued reaction, including the oxidation reaction of CO as well as the reaction of intermediate products of the burning reaction and unburnt components of the fuel. Therefore, heat recovery from the burning-reaction ongoing gas and the burning-reaction completed gas including the aforementioned heat is performed by the heat-recovery water tubes. As a result, effective use of heat can be made by the heat-recovery water tubes, so that the thermal efficiency is enhanced.

In the thirteenth aspect of the invention, part of the plurality of heat-recovery water tubes are arranged so as to be gathered in close contact. With this arrangement, the state of contact between the heat-recovery water tubes and the burning-reaction ongoing gas as well as the burning-reaction completed gas can be adjusted so that the amount of heat transfer can be adjusted.

In the fourteenth aspect of the invention, the plurality of heat-recovery water tubes are arranged so as to include different widths of gaps between adjacent heat-recovery water tubes. That is, the plurality of heat-recovery water tubes are arranged into an annular shape so that wider gaps and narrower gaps are provided. With this arrangement, the state of contact between the heat-recovery water tubes and the burning-reaction ongoing gas as well as the burning-reaction completed gas can be adjusted so that the amount of heat transfer can be adjusted.

In the fifteenth aspect of the invention, the plurality of heat-recovery water tubes are arranged into an annular shape to form a second water tube array. By arranging the second water tube array into an annular shape, the heat-recovery water tubes will make generally uniform contact with the burning-reaction ongoing gas as well as the burning-reaction completed gas, so that heat transfer from those gases can be conducted generally uniformly.

In the sixteenth aspect of the invention, the second water tube array is an annular water tube array of two or more arrays. Because the amount of heat recovery from the burning-reaction ongoing gas as well as the burning-reaction completed gas can be further increased, so that the efficiency of the water-tube boiler is enhanced. In this case, the arrangement is preferably such that the heat-recovery water tubes of the outer array are positioned between adjacent heat-recovery water tubes of the inner array.

In the seventeenth aspect of the invention, the second water tube array is an annular water tube array of two or more arrays, wherein the second water tube array has an inner-array opening provided at a portion of its inner array and communicating inner circumferential side and outer circumferential side of the inner array with each other, and an outer-array opening provided at a portion of its outer array and communicating inner circumferential side and outer circumferential side of the outer array with each other, and wherein the inner-array opening and the outer-array opening are arranged so as to be shifted circumferentially of the second water tube array. With this constitution, because heat recovery can be conducted by leading the burning-reaction ongoing gas and the burning-reaction completed gas to between the inner array and the outer array, the area of contact heat transfer can be allowed to be wide, so that the amount of contact heat transfer in the second water tube array is increased. The numbers of the inner-array opening and the outer-array opening are not limited to one, but may be provided in some plurality. Furthermore, the inner-array opening and the outer-array opening may be provided in numbers different from each other.

DETAILED DESCRIPTION OF THE PREFERRED EMBODIMENTS

Figure 1:
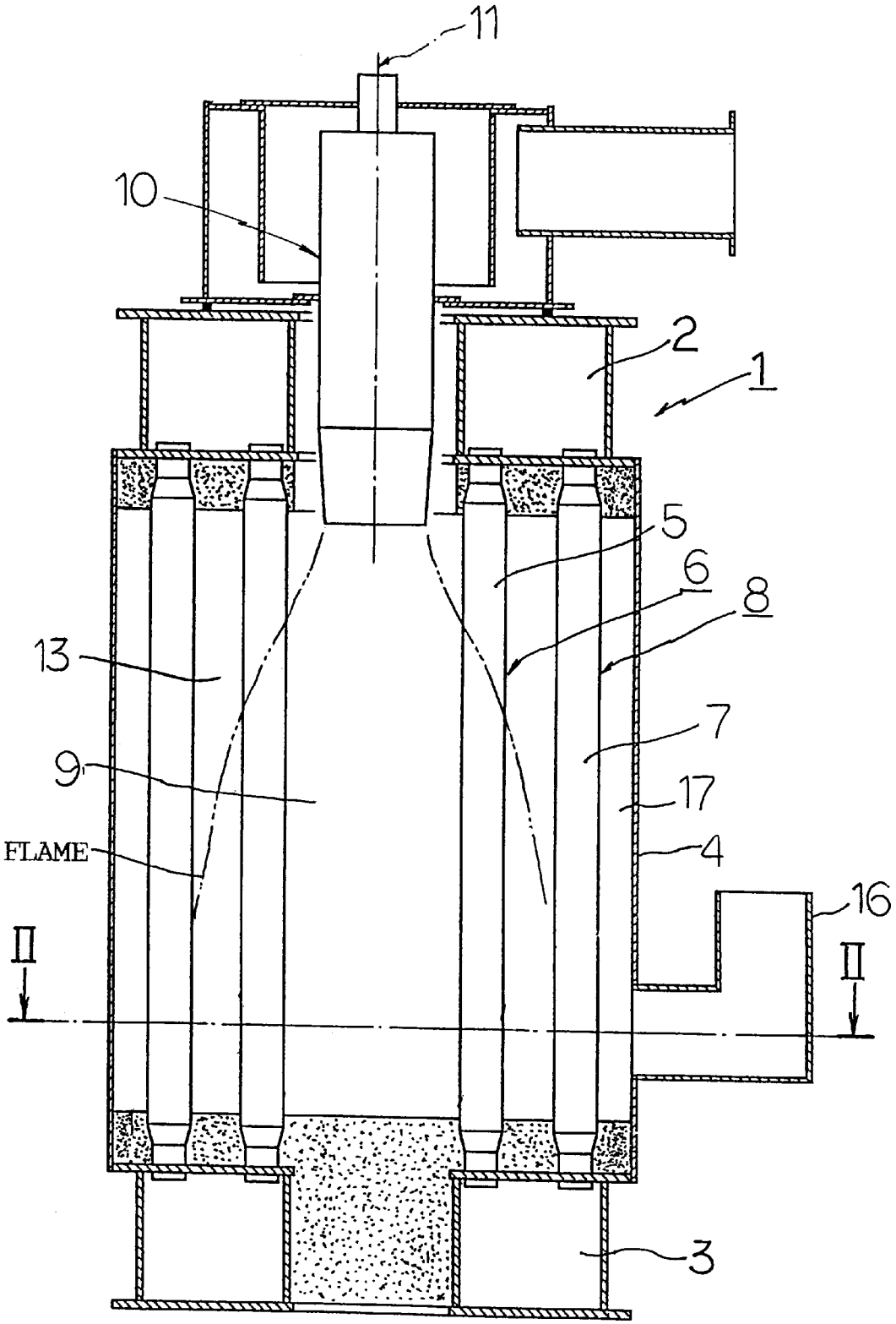
FIG. 1 is an explanatory view of a vertical cross section of a first embodiment of the present invention.

Hereinbelow, a first embodiment in which the present invention is applied to a multiple-tube type once-through boiler is described with reference to FIGS. 1 and 2. FIG. 1 is an explanatory view of a vertical cross section of the first embodiment of the invention, and FIG. 2 is an explanatory view of a cross section taken along the line II—II of FIG. 1.

Figure 2:
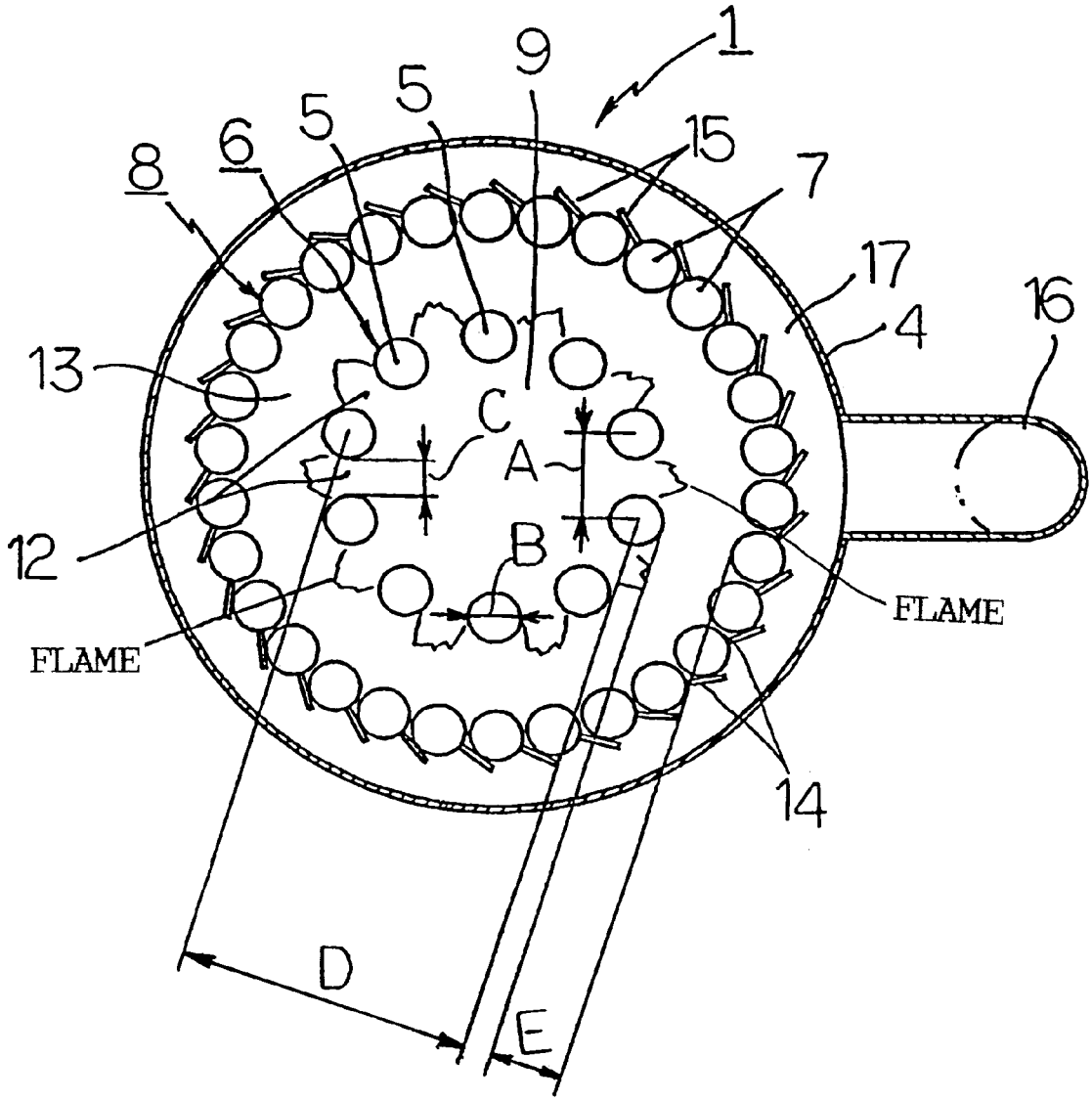
FIG. 2 is an explanatory view of a cross section taken along the line II—II of FIG. 1.

In FIGS. 1 and 2, a boiler body 1 has an upper header 2 and a lower header 3 arranged away from each other by a specified distance. An outer wall 4 is disposed between outer circumferences of these upper header 2 and lower header 3.

Between the upper header 2 and the lower header 3, a plurality (ten in the first embodiment) of water tubes 5 are arranged in an annular shape. These water tubes 5 constitute an annular first water tube array 6. Further between the upper header 2 and the lower header 3 and near the inner circumference of the outer wall 4, a plurality (thirty in the first embodiment) of heat-recovery water tubes 7 are arrayed into an annular shape to form an annular second water tube array 8. This second water tube array 8 in combination with the first water tube array 6 constitutes a double annular water tube array. The water tubes 5 and the heat-recovery water tubes 7 are connected at their both ends to the upper header 2 and the lower header 3, respectively.

A combustion chamber 9 of the boiler is defined by the upper header 2, the lower header 3 and the second water tube array 8. On top of the combustion chamber 9 is fitted combustion equipment 10. This combustion equipment 10 is inserted from inside (center) of the upper header 2 toward the combustion chamber 9, so that an axis 11 of the combustion equipment 10 is generally parallel to the water tubes 5 of the first water tube array 6. The combustion equipment 10 is a diffused-combustion type combustion equipment.

The combustion equipment 10 causes a zone where burning-reaction ongoing gas is present, i.e. a burning reaction zone, to be formed in the combustion chamber 9, whereas the first water tube array 6 is located in a zone out of the burning reaction zone where a flame is present (hereinafter, referred to as "flame-present zone"). The first water tube array 6 is disposed in the burning reaction zone so that the temperature of the burning-reaction ongoing gas after making contact with the water tubes 5 will be below 1400° C. Further, in the first water tube array 6, gaps 12 that allow the flow of burning-reaction ongoing gas are formed between one water tube 5 and another.

A zone 13 where burning reactions of intermediate products such as CO and HC and unburnt components of the fuel are continuously effected (hereinafter, referred to as "burning-reaction continuing zone") is provided between the first water tube array 6 and the second water tube array 8. Within this burning-reaction continuing zone 13, no heat-absorbing members such as the water tubes 5 are present.

In the second water tube array 8, gaps 14 between adjacent heat-recovery water tubes 7 (hereinafter, referred to as "second gap") are narrow, normally set to 1 to 4 mm. Further, on the outer circumferential side of the second water tube array 8, the heat-recovery water tubes 7 are each provided with a heat-transfer fin 15.

Further, the outer wall 4 is provided with an exhaust gas outlet 16. This exhaust gas outlet 16 communicates with an annular exhaust gas flow path 17 formed between the outer wall 4 and the second water tube array 8.

In the once-through boiler of the above constitution, when the combustion equipment 10 is activated, there arises burning-reaction ongoing gas within the combustion chamber 9. In the initial stage of the burning reaction of this burning-reaction ongoing gas, fuel decomposition is performed and then the decomposed fuel reacts with oxygen vigorously. Then at the succeeding stage, such intermediate products as CO and HC that have been generated in the burning reaction above are put into further reaction, and thus burning-reaction completed gas, which has completed burning reaction, is exhausted from the boiler body 1 as exhaust gas. In the region where the burning reaction is vigorously effected, there occurs a flame, normally.

The burning-reaction ongoing gas flows through central part of the first water tube array 6 nearly along its axis, as the gas expands toward the lower header 3, thus flowing into the burning-reaction continuing zone 13 through the gaps 12. Accordingly, as shown in FIG. 1, the flame is formed beyond the first water tube array 6 as the burning-reaction ongoing gas flows along. This means that the water tubes 5 are located inside the flame-present zone within the burning reaction zone. Then, the burning-reaction ongoing gas that causes the flame, when passing through the gaps 12, exchanges heat with heated fluid in the water tubes 5. The burning-reaction ongoing gas that causes the flame is rapidly cooled by this heat exchange, with the temperature lowering, by which the generation of thermal $NO_x$ is suppressed. In this case, because the first water tube array 6 is an annular water tube array, the burning-reaction ongoing gas that causes the flame makes uniform contact with the individual water tubes 5, so that the thermal load on the water tubes 5 becomes generally uniform. Further, because this burning-reaction ongoing gas is cooled by generally uniform contact with the water tubes 5, the reduction in $NO_x$ due to the individual water tubes 5 becomes generally uniform. Besides, as a result of this, the flame formation is lessened in this burning-reaction ongoing gas.

Then, the burning-reaction ongoing gas that has passed through the gaps 12 is flowed in the burning-reaction continuing zone 13 toward the second water tube array 8. Until the burning-reaction ongoing gas reaches the second water tube array 8, the burning-reaction ongoing gas will not make contact with any members that perform heat exchange, like the water tubes 5, so that the temperature of the burning-reaction ongoing gas little lowers. Therefore, the burning-reaction ongoing gas flows through the burning-reaction continuing zone 13 while continuing to make burning reaction, while an oxidation reaction from CO to $CO_2$ is accelerated. In this burning-reaction continuing zone 13, besides the aforementioned oxidation reaction, oxidation reactions of the intermediate products, unburnt components of the fuel and the like are also carried out.

The burning-reaction ongoing gas, thus becoming a high-temperature gas that has completed the burning reaction before it reaches the second water tube array 8, passes through the second gaps 14, flowing into the exhaust gas flow path 17. When the burning-reaction ongoing gas passes through the second gaps 14, more heat is transferred to the heated fluid within the heat-recovery water tubes 7 by the heat-transfer fins 15. The burning-reaction completed gas that has passed through the second gaps 14 and flowed into the exhaust gas flow path 17, after performing heat transfer from the outside of the second water tube array 8 to the heated fluid within the heat-recovery water tubes 7, is discharged as exhaust gas through the exhaust gas outlet 16 out of the boiler. In this case, because the second water tube array 8 is an annular water tube array comprised of a plurality of heat-recovery water tubes 7, burning-reaction ongoing gas and the burning-reaction completed gas make generally uniform contact with the individual heat-recovery water tubes 7, so that heat recovery from burning-reaction ongoing gas and the burning-reaction completed gas is effected by the entire second water tube array 8. Thus, the thermal load on the heat-recovery water tubes 7 becomes generally uniform also in the second water tube array 8.

In the above description, the flow of burning-reaction ongoing gas has been one directed along the radius of the first water tube array 6. Next, the description is focused on the flow of the burning-reaction ongoing gas along the axis of the first water tube array 6. Since the burning-reaction ongoing gas flows through central part of the first water tube array 6 generally along its axis while expanding toward the lower header 3 as described above, the burning-reaction ongoing gas has lowered in temperature due to the heat transfer to the water tubes 5 to more extents in more downstream. Therefore, the generation of thermal $NO_x$ is suppressed. Also, because the first embodiment is a once-through boiler, heated fluid is fed from the lower header 3 to the water tubes 5 and into the heat-recovery water tubes 7, ascends in the water tubes 5 and the heat-recovery water tubes 7, while being heated, and is taken out from the upper header 2 as steam.

Now the once-through boiler of this first embodiment is explained in more detail. The first embodiment is an embodiment of a once-through boiler with an evaporation of 500 to 4000 kg per hour. In the once-through boiler of the first embodiment, the outside diameter B of the water tubes 5 is about 60 mm. While once-through boilers normally employ water tubes 5 having an outside diameter B of about 25 to 80 mm, water-tube boilers on the whole generally employ water tubes 5 having an outside diameter B of about 20 to 100 mm. Further in this first embodiment, the diameter D of the pitch circle in arranging a plurality of water tubes 5 into a circularity as described before is about 344 mm. This diameter D needs to be at least 100 mm. That is, a smaller diameter D would result in a smaller space on the inner circumferential side of the first water tube array 6, making it difficult to continue a stable burning reaction. On the other hand, a larger diameter D would result in a larger space on the inner circumferential side of the first water tube array 6, making it more likely that high-temperature regions that accelerate the generation of thermal $NO_x$ are generated inside the space. Therefore, with considerations to this point, the upper limit of the diameter D is determined. Further, the upper limit of the diameter D is determined depending on the required amount of evaporation of the boiler. For example, for a water-tube boiler with the amount of evaporation of 4000 kg/hr, the upper limit of its diameter D is 1000 mm.

Also in this first embodiment, the center-to-center distance A of adjacent water tubes 5 in the first water tube array 6 is about 106 mm, and the ratio of this center-to-center distance A to the outside diameter B of the water tubes 5, A/B, is 1.8. Then, in the case where the gaps 12 are provided between the water tubes 5 as in this first embodiment, the width C of the gaps 12 is set to such a value that the burning reaction will not be halted by the burning-reaction ongoing gas being cooled by the water tubes 5. The width C of the gaps 12 in this case needs to be at least 1 mm. Accordingly, for the gaps 12 to be provided between adjacent water tubes 5, the aforementioned ratio A/B is so set that $1<A/B\leqq 2$. This ratio A/B may be changed depending on the degree to which the reduction in $NO_x$ is required. In terms of this, the width C of the gaps 12 in the first embodiment is equal to the difference between the center-to-center distance A and the outside diameter B, being about 46 mm.

Further, the combustion equipment 10 in this first embodiment has an air ratio set to 1.3, in which case the maximum temperature of the burning-reaction ongoing gas is about 1700° C. Generally, the combustion equipment for water-tube boilers makes combustion with the air ratio set to within a range of 1.1 to 1.3, in which case the maximum temperature of burning-reaction ongoing gas is about 1800° C. for an air ratio range of 1.1 to 1.2 and about 1700° C. for another air ratio range of 1.2 to 1.3.

By setting the center-to-center distance A, the outside diameter B and the like of the water tubes 5 in the way as described above, the temperature of the burning-reaction ongoing gas at the time when it has passed through the gaps 12 drops to about 1100° C. by cooling with the water tubes 5. This temperature is below such a temperature that the generation of thermal $NO_x$ will be largely reduced (about 1400° C.). This makes it possible to implement a once-through boiler which is low in the discharge amount of $NO_x$. In addition, the discharge amount of $NO_x$ of the once-through boiler in the first embodiment is about 30 ppm, as converted with 0% $O_2$. Besides, this temperature is above such a temperature that the oxidation reaction from CO to $CO_2$ will be effected vigorously (about 800° C.). This causes the oxidation reaction from CO to $CO_2$ to be effected vigorously when the burning-reaction ongoing gas passes through the inside of the burning-reaction continuing zone 13, making it possible to implement a once-through boiler which is low in the discharge amount of CO.

As seen above, in the once-through boiler of the first embodiment, the temperature of burning-reaction ongoing gas that has flowed out from the gaps 12 of the first water tube array 6 is controlled to about 1100° C. However, it should be controlled to within a range of 800 to 1400° C. depending on the degree to which $NO_x$ reduction and CO reduction are required. In this connection, the temperature of burning-reaction ongoing gas that flows out from the gaps 12 is preferably as low as possible in terms of the $NO_x$ reduction, while it is preferably as high as possible in terms of the CO reduction. From this point of view, the temperature is preferably set within a range of 900 to 1300° C.

Further, in the first embodiment, the radial interval E between the first water tube array 6 and the second water tube array 8 is set as the width of the burning-reaction continuing zone 13. The interval E is about 84 mm, 1.4 times larger than the outside diameter B. By setting the interval E in this way, the residence time of burning-reaction ongoing gas within the burning-reaction continuing zone 13 is adjusted to about 47 milliseconds. In this case, the discharge amount of CO is about 15 ppm. That is, in order to ensure the occurrence of aforementioned oxidation reaction, the burning-reaction ongoing gas needs to be kept above a certain temperature (about 800° C.), while more than a certain reaction time is necessary at the same time. The reaction time required becomes shorter with increasing temperature of the burning-reaction ongoing gas, while the reaction time required becomes longer with decreasing temperature of the burning-reaction ongoing gas. Therefore, the set value of the interval E is changed depending on the temperature of the burning-reaction ongoing gas that flows out from the gaps 12, by which the residence time of the burning-reaction ongoing gas in the burning-reaction continuing zone 13 is adjusted. Besides, the interval E is changed depending on the number and width C of the gaps 12. The lower limit for this residence time is selected from a range of 1 to 10 milliseconds. As a result, the lower limit of the interval E is about 0.5 time as large as the outside diameter B. Also, the residence time, although a somewhat longer set value thereof is advantageous in terms of the CO reduction, but is determined depending on the degree to which the CO reduction and the boiler downsizing are demanded. In this case, the upper limit of the interval E is preferably six times as large as the outside diameter B.

Figure 3:
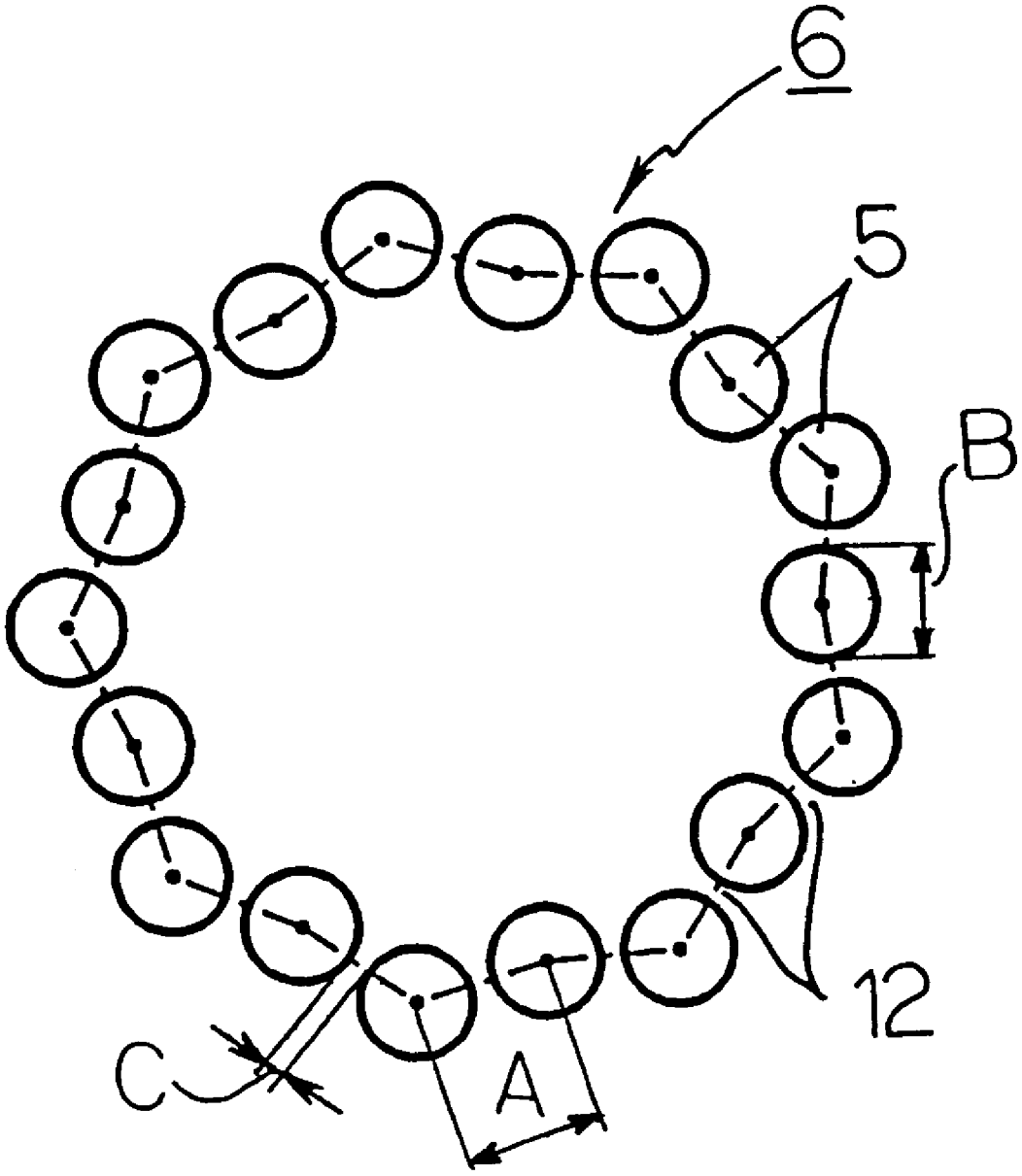
FIG. 3 is an explanatory view of a second embodiment of the invention, schematically showing an annular arrangement example of water tubes.
Figure 4:
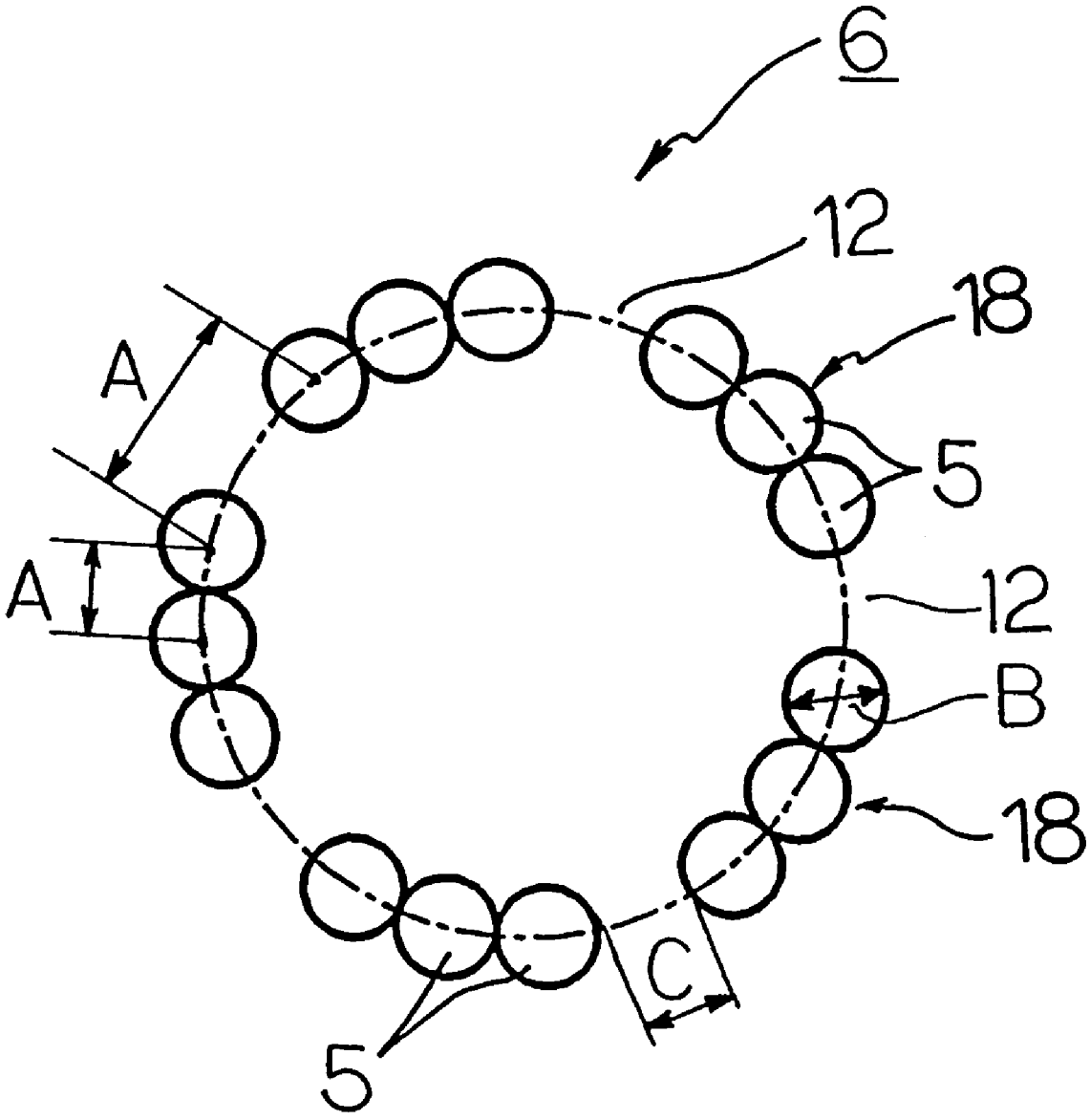
FIG. 4 is an explanatory view of a third embodiment of the invention, schematically showing an annular arrangement example of water tubes.
Figure 5:
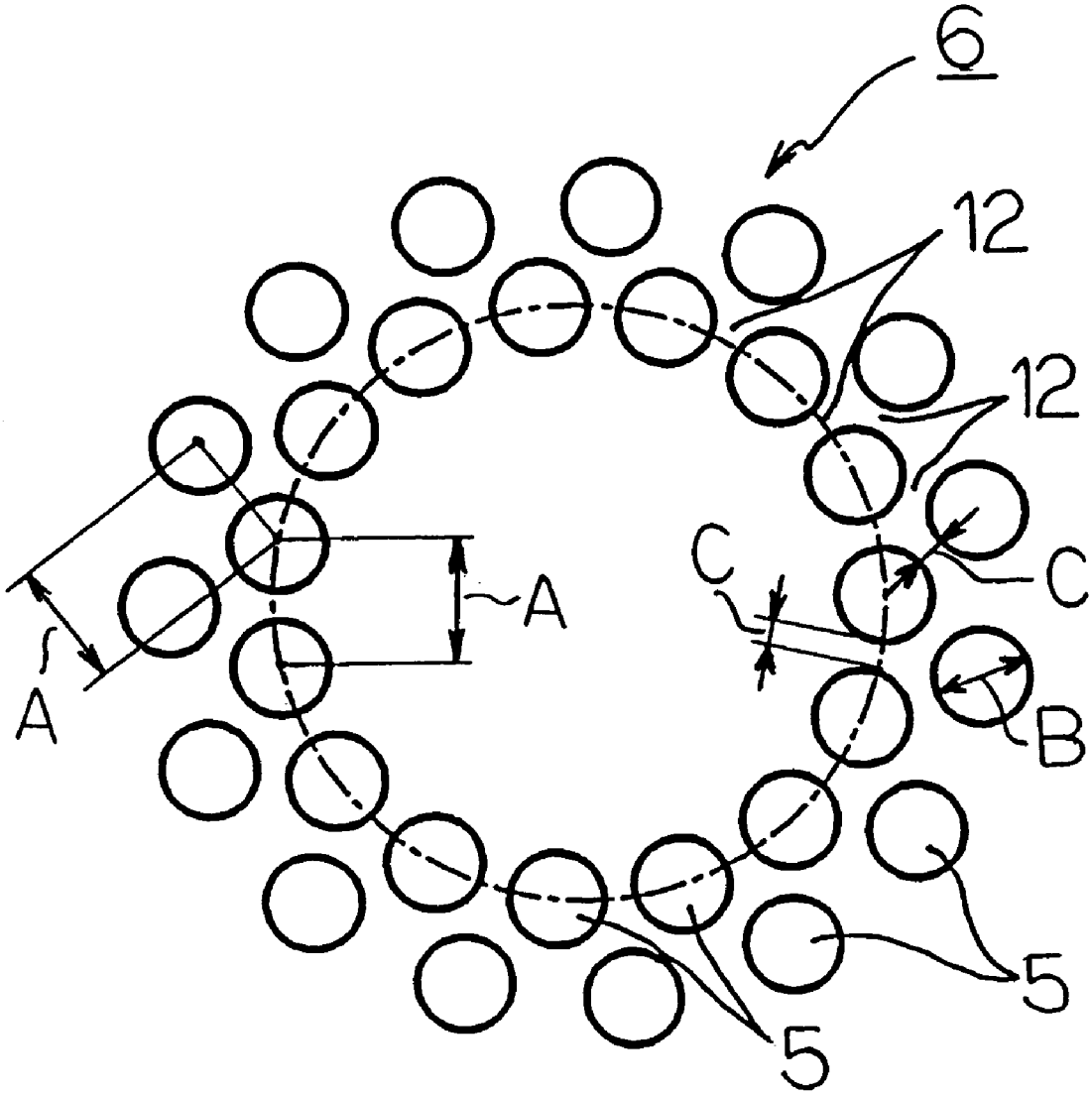
FIG. 5 is an explanatory view of a fourth embodiment of the invention, schematically showing an annular arrangement example of water tubes.

In the first embodiment as described above, a plurality of water tubes 5 have been arranged in the burning reaction zone within the combustion chamber 9 generally into a circularity and at generally equal intervals. However, the arrangement of the water tubes 5 in this first embodiment is not limited to such an arrangement, but may be arranged into such annular arrangements as shown in FIGS. 3 to 5. It is noted here that, in the following description of embodiments, component members similar to those of the first embodiment are designated by like reference numerals and their detailed description is omitted. Besides, in FIGS. 3 to 5, only the first water tube array 6 is shown, the rest of the arrangement being omitted in the illustration.

Referring first to the once-through boiler of a second embodiment as shown in FIG. 3, a plurality of water tubes 5 are arranged into an annular shape in such a way that the line connecting the centers of adjacent water tubes 5 with each other (one-dot chain line in FIG. 3) is staggered with projections and recesses. In this second embodiment, the water tubes 5 are so arranged as to be each shifted from the adjacent water tube 5 centrally or radially of the first water tube array 6. With this arrangement, the number of water tubes 5 can be increased, as compared with the case where the water tubes 5 are arranged into a circularity. In this second embodiment, the ratio of the center-to-center distance A to the outside diameter B, A/B, is set to 1.2. Although the water tubes 5 are staggered so as to be shifted alternately inside and outside in this second embodiment, they may be arranged so that every some plurality of water tubes are shifted alternately, depending on the circumstances of the embodiment.

Referring next to the once-through boiler of a third embodiment as shown in FIG. 4, in which a plurality of water tubes 5 are arranged into a circularity, the plurality of water tubes 5 are arranged so as to be partly gathered in close contact. In this third embodiment, the plurality of water tubes 5 are unitized into groups 18 each comprising a specified number (three in FIG. 4) of water tubes, where a plurality (five in FIG. 4) of groups 18 are arranged to make up the first water tube array 6. Further, within each group 18, the water tubes 5 are arranged in a close contact state without gaps. Accordingly, the aforementioned ratio A/B is 1 within each group 18. Then, the gaps 12 are formed between the groups 18. The ratio of the center-to-center distance A to the outside diameter B of water tubes 5 adjacent to each other with a gap 12 therebetween, A/B, is 2.0. As a result, in the third embodiment, the ratio A/B is within a range of $1 \leqq A/B \leqq 2$. In this way, on condition that the water tubes 5 are so arranged as to be partly gathered in close contact, the number of gaps 12 to be formed in the first water tube array 6 can be adjusted, while the width C of the gaps 12 between the individual groups 18 can also be adjusted. Therefore, controlling the flow of burning-reaction ongoing gas from the inside of the first water tube array 6 to the gaps 12 in accordance with the characteristics of the combustion equipment 10 makes it possible to adjust the contact time for which the first water tube array 6 and the burning-reaction ongoing gas are kept in contact with each other, and further to adjust the amount of heat recovery by the water tubes 5 as well as the temperature of the burning-reaction ongoing gas after passing through the gaps 12. Although the number of water tubes 5 of one group 18 has been set to equal among the individual groups 18 in this third embodiment, it is also preferred that the number of water tubes 5 is made different among the individual group 18 depending on the circumstances of the embodiment.

Next, the once-through boiler of a fourth embodiment as shown in FIG. 5 is an example in which a plurality of water tubes 5 are arranged into a plurality of annular arrays, and into two annular arrays in this fourth embodiment. In this fourth embodiment, the center-to-center distance A of the water tubes 5 is set as follows. Referring first to the water tubes 5 of the inner array, the ratio of the center-to-center distance A to the outside diameter B of adjacent water tubes 5 in the array, A/B, is set to 1.3. Referring to the water tubes 5 of the outer array, the ratio of the center-to-center distance A to the outside diameter B of water tubes 5 adjacent to their corresponding water tubes 5 of the inner array, A/B, is set to 1.3. Further, in this fourth embodiment, the water tubes 5 of the outer array are positioned between their adjacent water tubes 5 of the inner array. Accordingly, the first water tube array 6 is so configured that the plurality of water tubes 5 are staggered circumferentially. Such an arrangement of the water tubes 5 can increase the amount of heat recovery from burning-reaction ongoing gas so that the burning-reaction ongoing gas can be cooled sufficiently. Increased amount of heat recovery like this in turn allows a large-capacity combustion equipment 10 to be used. It is noted here that although the plurality of water tubes 5 are arranged into two annular arrays in the fourth embodiment, it is also preferred that the water tubes 5 are arranged into three or larger pluralities of arrays depending on the circumstances of the embodiment.

In the above first to fourth embodiments, the gaps 12 have been all of the same width C. However, the water tubes 5 may be arranged so as to include different widths C of the gaps 12, depending on the circumstances of the embodiment.

Figure 6:
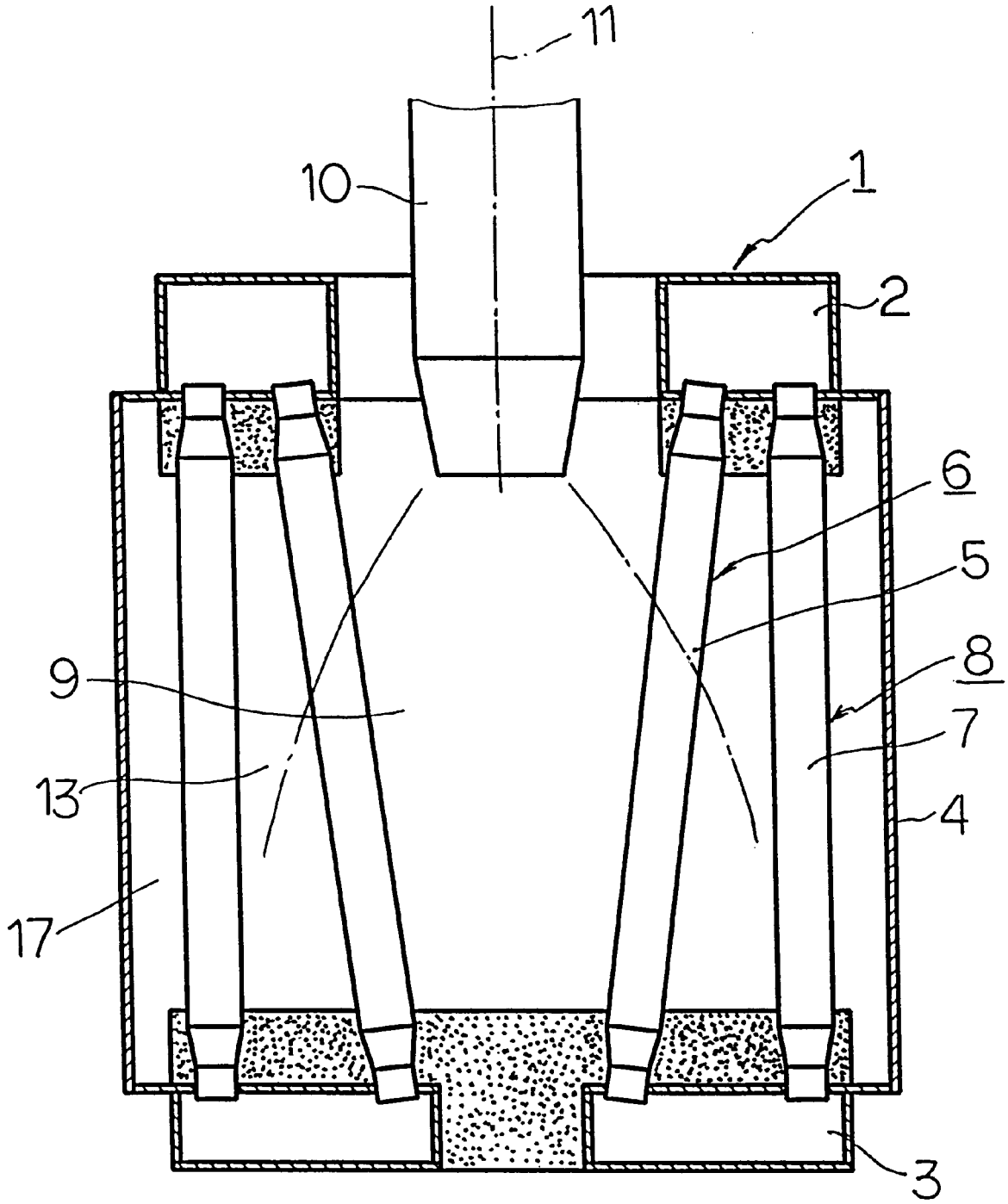
FIG. 6 is an explanatory view of a fifth embodiment of the invention, schematically showing a configuration example of water tubes.
Figure 7:
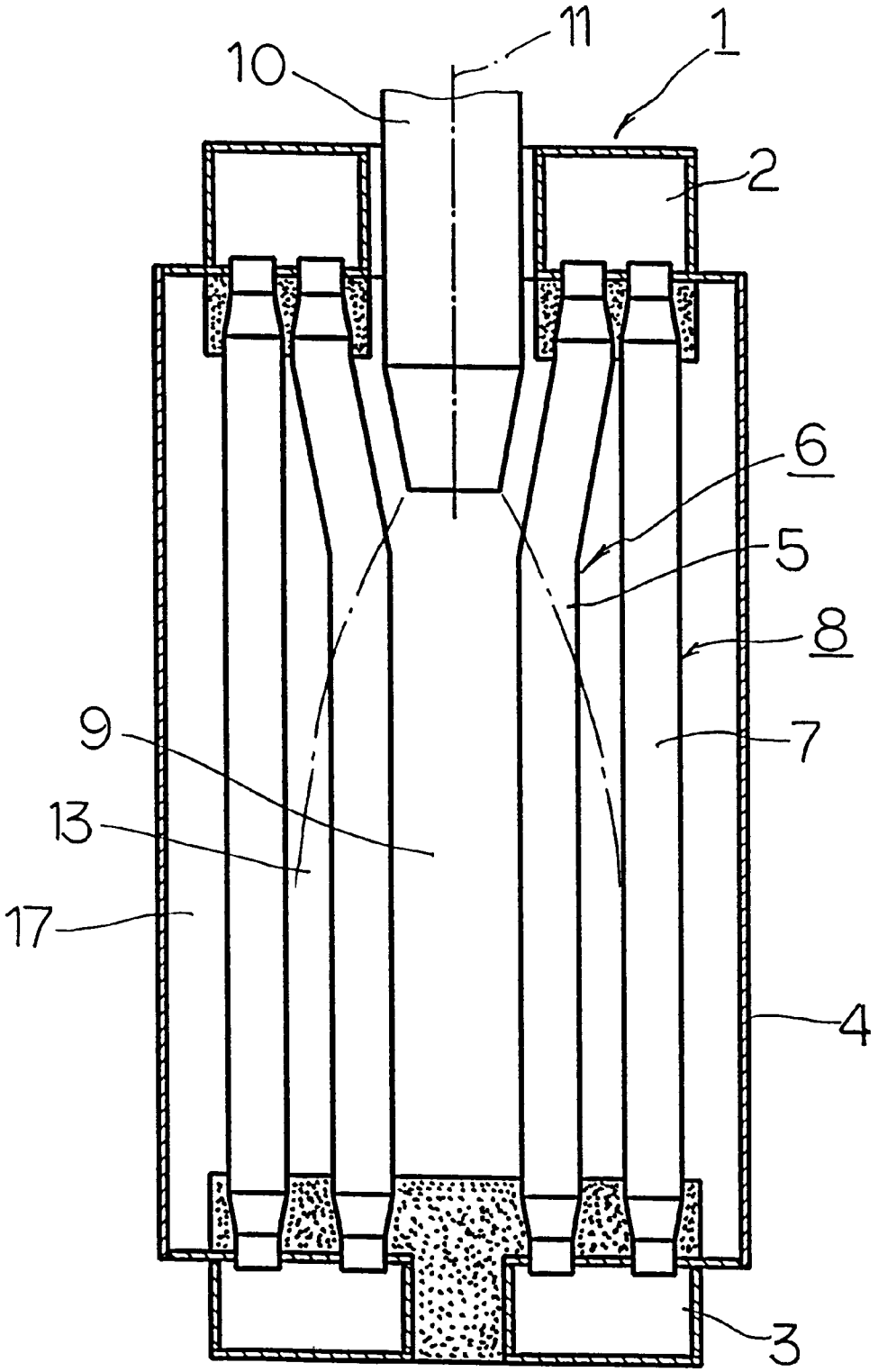
FIG. 7 is an explanatory view of a sixth embodiment of the invention, schematically showing a configuration example of water tubes.
Figure 8:
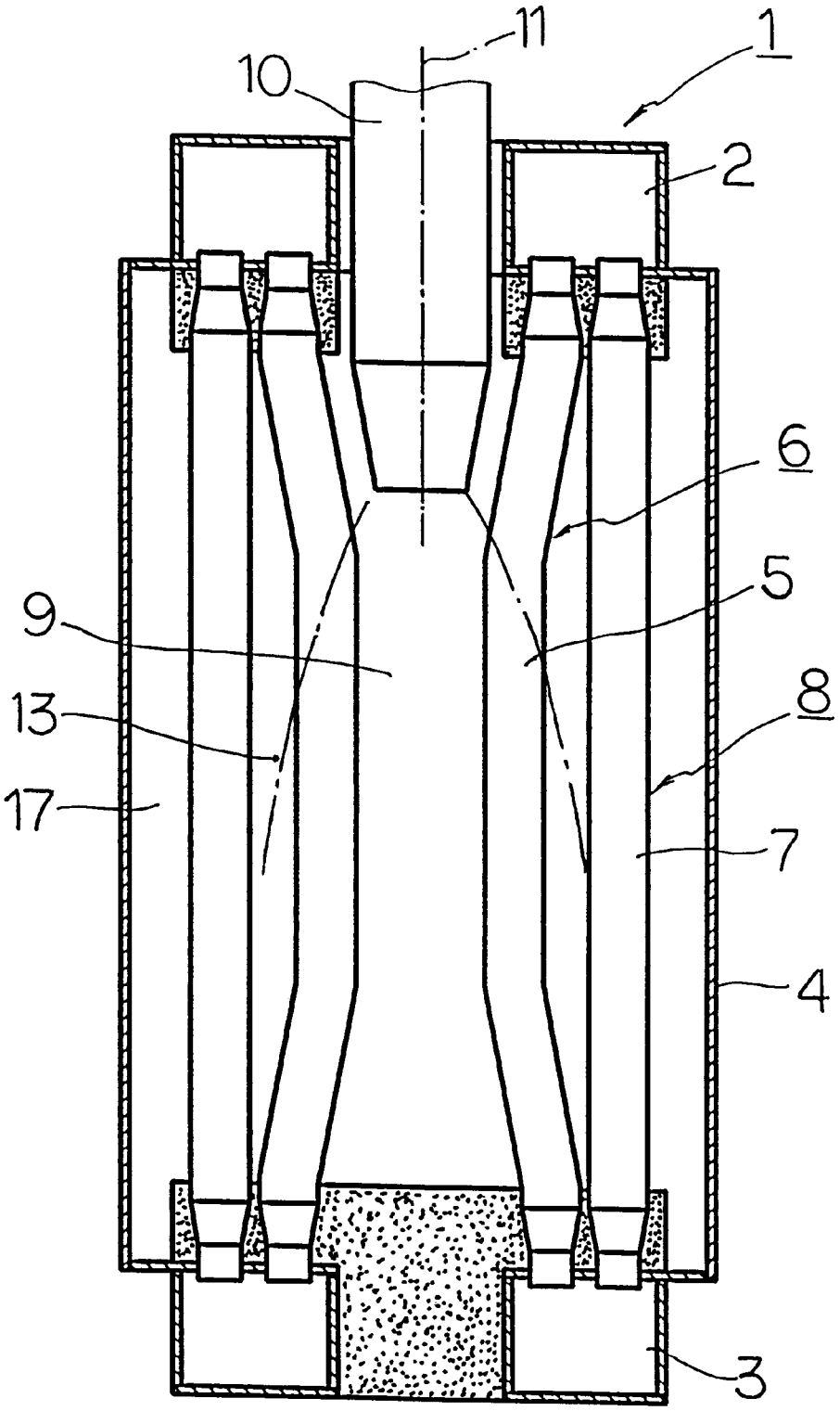
FIG. 8 is an explanatory view of a seventh embodiment of the invention, schematically showing a configuration example of water tubes.

In the above-described first to fourth embodiments, a plurality of vertical water tubes 5 are arranged into an annular shape to form the first water tube array 6 of a generally cylindrical shape. However, the present invention does not limit the water tubes 5 to vertical water tubes but may be of such arrangements as shown in FIGS. 6 to 8. It is noted here that, in the following embodiments, components similar to those of the first to fourth embodiments are designated by like reference numerals and their detailed description is omitted. Further, in fifth to seventh embodiments, the second water tube array 8 is of a cylindrical configuration that a plurality of vertical heat-recovery water tubes 7 are arranged into such an annular shape as to surround the first water tube array 6, as in the first embodiment.

Referring first to the once-through boiler of a fifth embodiment as shown in FIG. 6, water tubes 5 are provided as tilted tubes. The water tubes 5 in this fifth embodiment are tilted with their upper end side directed outward of the boiler body 1, where a plurality of water tubes 5 in this tilted state are arranged into an annular shape, thereby forming a first water tube array 6 into a tapered shape with the taper gradually increasing on the lower side. With this constitution, the individual water tubes 5 are tilted so as to traverse the direction of the axis 11 of the combustion equipment 10, i.e., the direction in which fuel is spouted out from the combustion equipment 10, thus making good contact with burning-reaction ongoing gas. Accordingly, the cooling effect of the water tubes 5 on the burning-reaction ongoing gas can be enhanced, contributing to the reduction in $NO_x$. Further, in this fifth embodiment, the water tubes 5 can be tilted without changing the position where the upper header 2 and the water tubes 5 are connected together, in which case the water tubes 5 can be positioned within the burning reaction zone.

Referring next to the once-through boiler of a sixth embodiment as shown in FIG. 7, the water tubes 5 are provided as bent tubes. The water tubes 5 in the sixth embodiment are formed by making bent portion halfway, and by tilting the upper half outward of the boiler body 1, with the lower half vertical. Further, a plurality of these bent water tubes 5 are arranged into an annular shape, thereby forming a first water tube array 6 of a funnel shape. With this constitution, the lower half of the water tubes 5 become closer to the axis 11 of the combustion equipment 10 than the connecting position of the water tubes 5 in the upper header 2. As a result, the contact between the individual water tubes 5 and the burning-reaction ongoing gas becomes good, so that the cooling effect of the water tubes 5 on the burning-reaction ongoing gas can be enhanced, which contributes to the reduction in $NO_x$. Further, in this sixth embodiment, without changing the connecting position of the upper header 2, the individual water tubes 5 and the individual heat-recovery water tubes 7, only a change in the shape of the water tubes 5 makes it possible to locate the lower half of the water tubes 5 within the burning reaction zone, and besides to set to a desired size the interval E of the burning-reaction continuing zone 13 in the lower half of the water tubes 5.

Next, in the once-through boiler of a seventh embodiment as shown in FIG. 8, the water tubes 5 are provided as bent tubes, where bent portions are formed at upper and lower two places. The water tubes 5 in this seventh embodiment are so formed that upper and lower portions of the water tubes 5 are tilted outward of the boiler body 1. Further, a plurality of these bent water tubes 5 are arranged into an annular shape, thereby forming a first water tube array 6. In this constitution, middle portions of the individual water tubes 5 become closer to the axis 11 of the combustion equipment 10 than the connecting position of the water tubes 5 in the upper and lower headers 2, 3. As a result, the contact between the individual water tubes 5 and the burning-reaction ongoing gas becomes good, so that the cooling effect of the water tubes 5 on the burning-reaction ongoing gas can be enhanced, which contributes to the reduction in $NO_x$. Further, in this seventh embodiment, without changing the connecting position of the upper and lower headers 2, 3, the individual water tubes 5 and the individual heat-recovery water tubes 7, only a change in the shape of the water tubes 5 makes it possible to locate the middle portions of the water tubes 5 within the burning reaction zone, and besides to set to a desired size the interval E of the burning-reaction continuing zone 13 in the middle portions of the water tubes 5.

Although the water tubes 5 have been provided as bent tubes having one or two bent portions in the sixth and seventh embodiments, those having curved portions instead of the bent portions may also be used. Also, the bent tubes may be those having either one of bent portions or curved portions or those having both of them. Furthermore, the bent tubes are not limited to those having one bent or curved portion. Besides, the bent tubes include those which are curved on the whole.

Further, although the water tubes 5 constituting the first water tube array 6 have been provided as vertical tubes, tilted tubes or bent tubes in the first to seventh embodiments, the present invention done not necessarily require the water tubes 5 to be all of the same kind, but allows the water tubes 5 of two or more kinds to be combined together in use. Also, the water tubes 5 may be those enhanced in heat transfer performance by adding grooves or fins on the outer or inner circumferential surfaces. Besides, the water tubes 5 are not necessarily required to be all equal in outside diameter, and it is permitted to use those of different diameter as part of the water tubes 5. Further, in the arrangement in which the first water tube array 6 is formed into two or more annular arrays, the water tubes 5 may be arranged so as to be different in number between inner array and outer array depending on the circumstances of the embodiment. Whereas the water-tube boilers according to the present invention allow the arrangement configuration of the plurality of water tubes 5 to be changed in various ways without departing the technical concept of the present invention as described before, it is preferable to arrange the water tubes 5 so that the burning-reaction ongoing gas makes uniform contact with the individual water tubes 5 of the first water tube array 6, depending on the output of the combustion equipment 10 and the formation state of the burning-reaction ongoing gas. Also, although no water tubes are arranged in the burning-reaction continuing zone 13 formed between the first water tube array 6 and the second water tube array 8 in the first embodiment, the water-tube boilers according to the present invention allow a specified number of water tubes to be arranged in the burning-reaction continuing zone 13 without departing the technical concept of the present invention.

Figure 9:
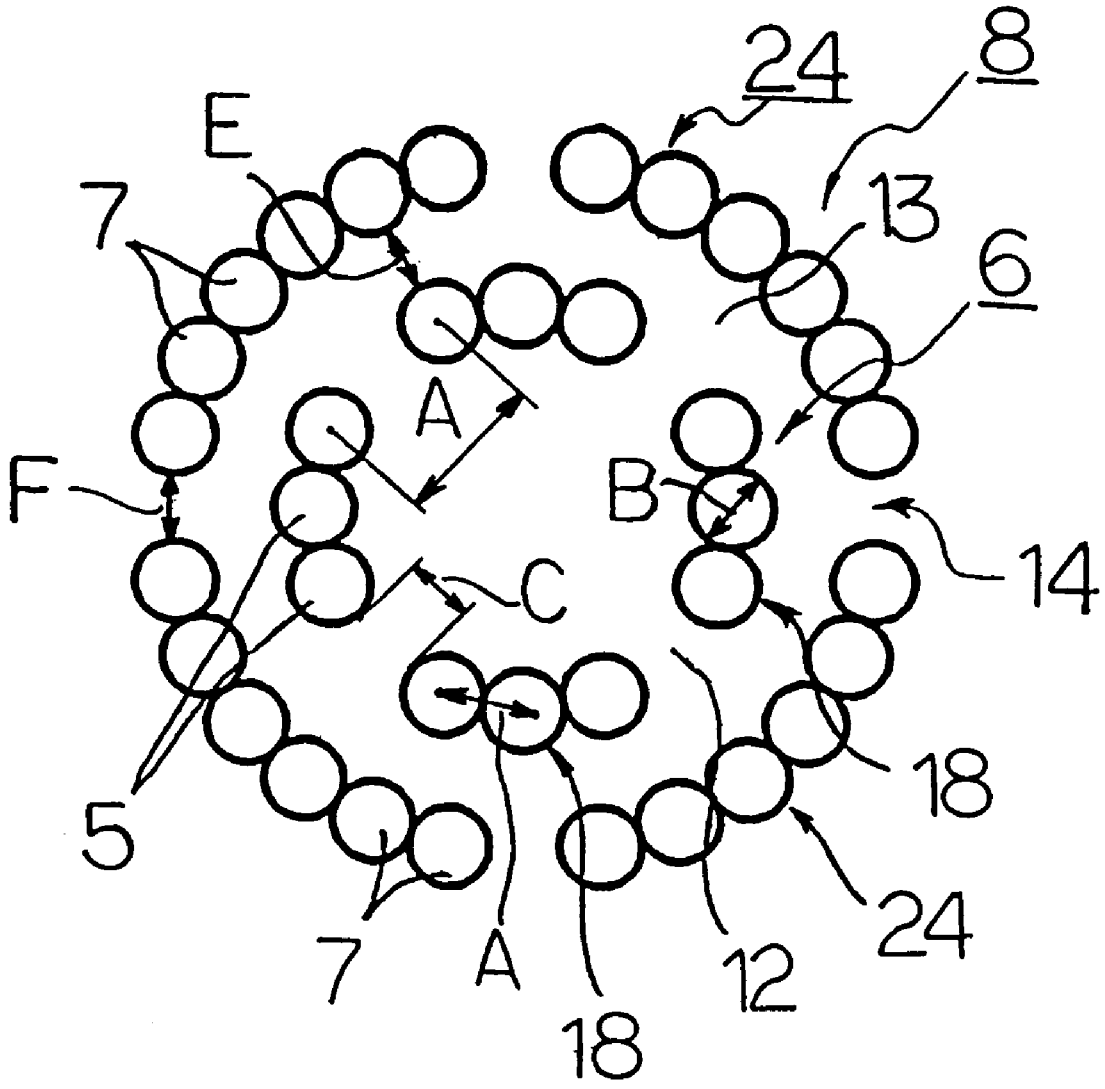
FIG. 9 is an explanatory view of an eighth embodiment of the invention, schematically showing an arrangement example of heat-recovery water tubes.
Figure 10:
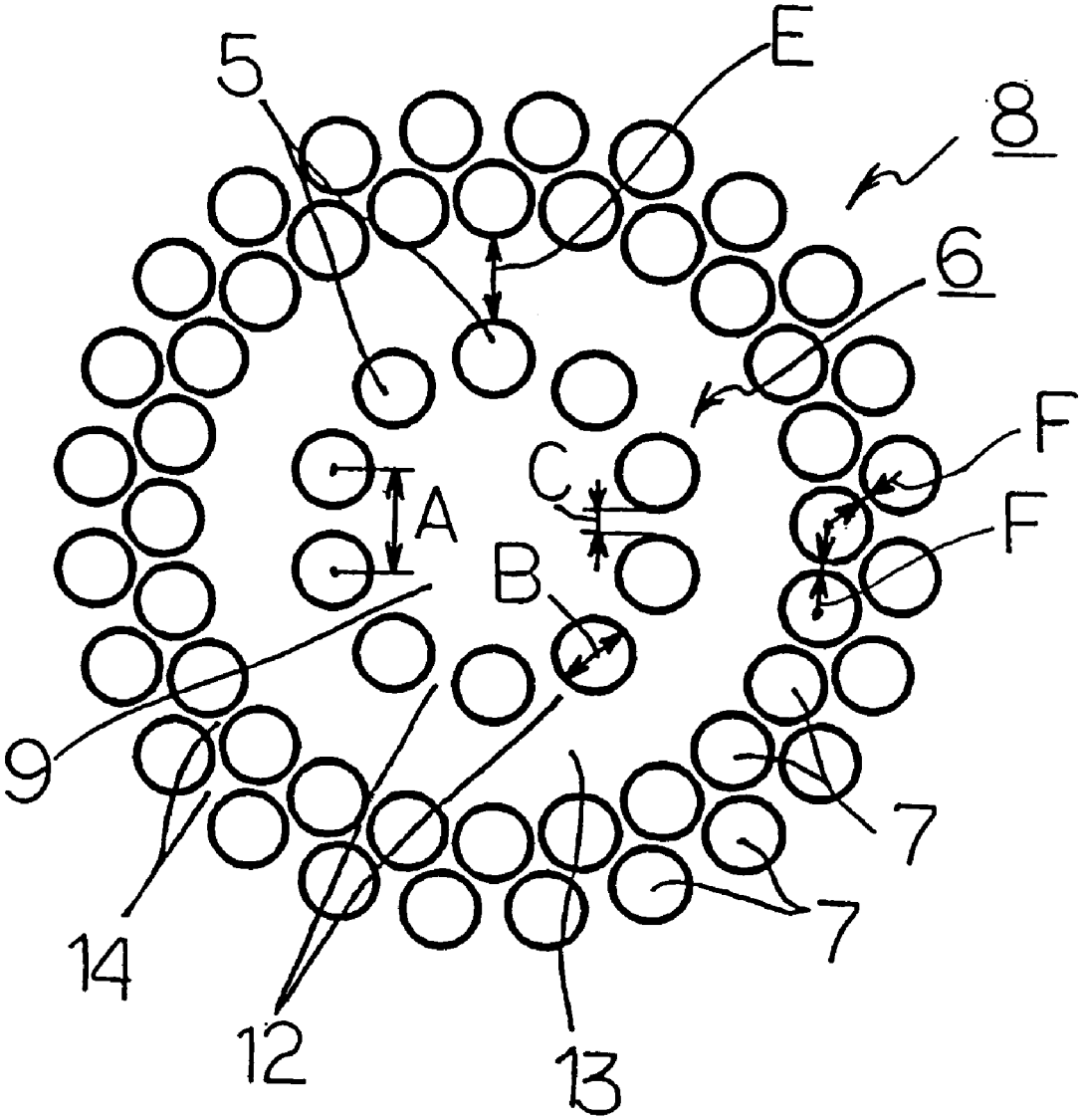
FIG. 10 is an explanatory view of a ninth embodiment of the invention, schematically showing an arrangement example of heat-recovery water tubes.
Figure 11:
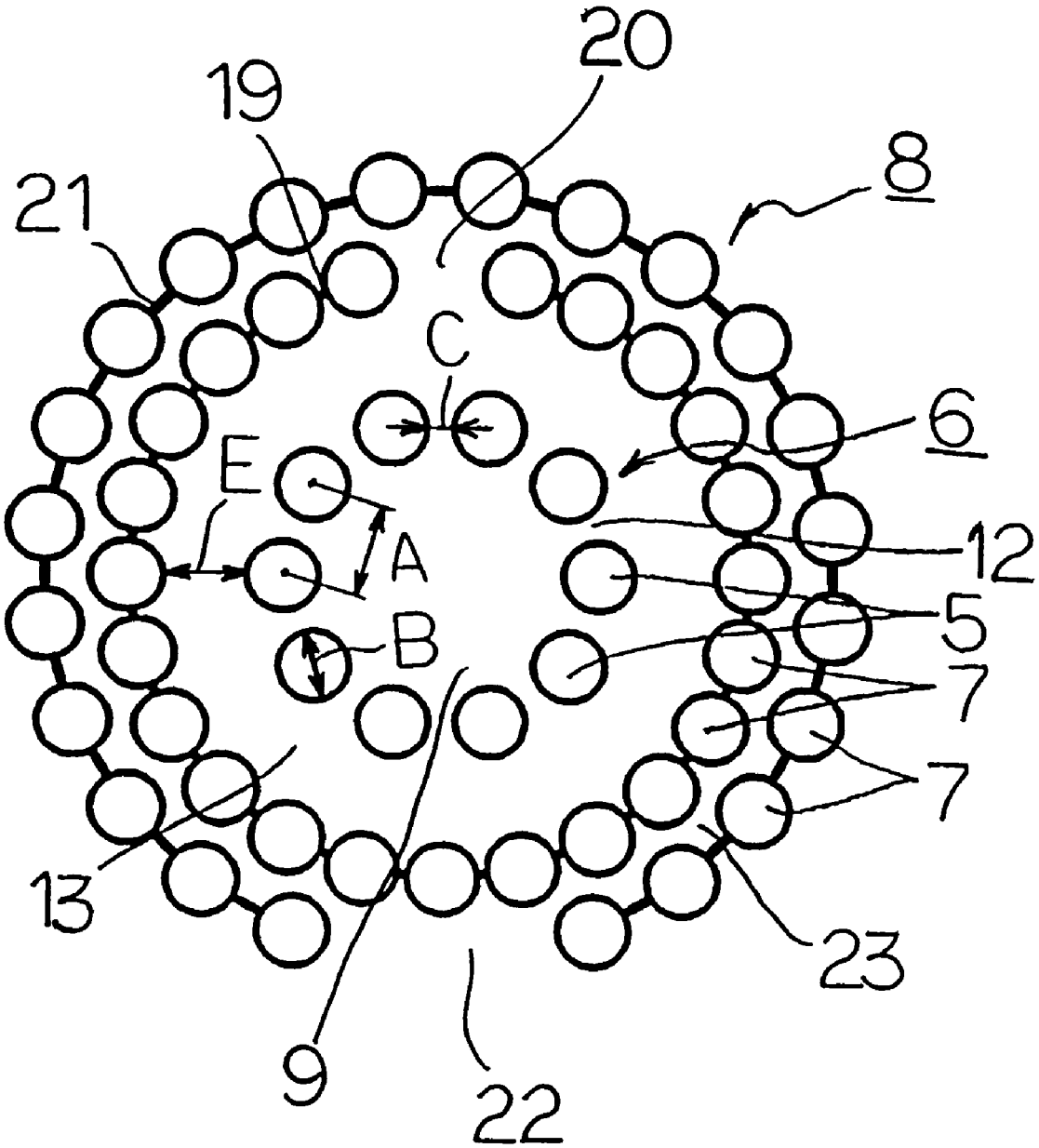
FIG. 11 is an explanatory view of a tenth embodiment of the invention, schematically showing an arrangement example of heat-recovery water tubes.

In the first embodiment and the fifth to seventh embodiments, a plurality of heat-recovery water tubes 7 are arranged at generally equal intervals and generally into a circularity, thereby forming the annular second water tube array 8 of one array. However, the arrangement of the heat-recovery water tubes 7 in the present invention is not limited to those of the above embodiments, but may be, for example, into such ones as shown in FIGS. 9 to 11. In addition, in eighth to tenth embodiments presented below, component members similar to those of the first to seventh embodiments are designated by similar reference numerals and their detailed description is omitted. Further, in FIGS. 9 to 11, only the first water tube array 6 and the second water tube array 8 are shown, the rest of the arrangement being omitted in the illustration.

Referring first to the second water tube array 8 of the eighth embodiment as shown in FIG. 9, in which a plurality of heat-recovery water tubes 7 are arranged into a circularity, the plurality of heat-recovery water tubes 7 are arranged so as to be partly gathered in close contact. In this eighth embodiment, the plurality of heat-recovery water tubes 7 are unitized into groups 24 each comprising a specified number (six in FIG. 9) of heat-recovery water tubes, where a plurality of groups 24 (four groups in FIG. 9) are arranged to make up the second water tube array 8. Further, within each group 24, the heat-recovery water tubes 7 are arranged in a close contact state without gaps, while the second gaps 14 are formed between one group 24 and another. With this constitution, the burning-reaction ongoing gas that has passed through the gaps 12 flows along the inner circumferential side of the groups 24, thus flowing out to the second gaps 14. The arrangement that the plurality of heat-recovery water tubes 7 are arranged so as to be partly gathered into close contact as shown above makes it possible to adjust the number of second gaps 14 to be formed in the second water tube array 8, and also to adjust the width F of the second gaps 14 between the individual groups 24. Therefore, by controlling the flow of the burning-reaction ongoing gas, which ranges from the inside of the second water tube array 8 to the second gaps 14, and the burning-reaction completed gas, the amount of heat recovery by the heat-recovery water tubes 7 and the temperature of the burning-reaction completed gas that has passed through the second gaps 14 can be adjusted. Although the number of heat-recovery water tubes 7 of one group 24 has been set to equal among the individual groups 24 in this eighth embodiment, it is also preferred that the number of heat-recovery water tubes 7 is made different among the individual group 24 depending on the circumstances of the embodiment.

In this eighth embodiment, the first water tube array 6 is so arranged, like the second water tube array 8, that a group 18, in which a plurality of water tubes 5 are arranged so as to be partly gathered in close contact in the unit of every specified number (three in FIG. 9) of water tubes 5, is formed, and this group 18 is arranged in a plurality of groups (four groups in FIG. 9), by which gaps 12 are formed between the individual groups 18. Then, these gaps 12 are positioned so as to confront the individual groups 24 of the heat-recovery water tubes 7, respectively. In this eighth embodiment, the ratio of the center-to-center distance A to the outside diameter B, A/B, is 1 within each group 18, and 2.0 between water tubes 5 adjacent to each other with the gap 12 therebetween. Also, a ratio of the interval E of the burning-reaction continuing zone 13 to the outside diameter B of the water tubes 5, E/B, is 0.8. In this way, with the arrangement that the gaps 12 in the first water tube array 6 are partly formed, while the second gaps 14 in the second water tube array 8 are partly formed, and that these gaps 12 and second gaps 14 are arranged so as not to overlap with one another radially of the first water tube array 6 and the second water tube array 8, the flow path of burning-reaction ongoing gas ranging from the gaps 12 to the second gaps 14 can be set to a long one so that its residence time in the burning-reaction continuing zone 13 becomes long. Accordingly, the progress of oxidation reaction is ensured, which contributes to a further increase in the amount of contact heat transfer in the second water tube array 8.

Next, the second water tube array 8 of a ninth embodiment as shown in FIG. 10 is formed by arranging heat-recovery water tubes 7 into a multiple-array annular shape. The second water tube array 8 of this ninth embodiment has the heat-recovery water tubes 7 arranged into a two-array annular shape. In this second water tube array 8, the heat-recovery water tubes 7 of the outer array are placed between adjacent heat-recovery water tubes 7 of the inner array, by which a plurality of heat-recovery water tubes 7 are staggered circumferentially of the second water tube array 8. Such an arrangement of the heat-recovery water tubes 7 allows the amount of heat recovery from burning-reaction ongoing gas and the burning-reaction completed gas in the second water tube array 8 to be set to a larger one. In the ninth embodiment, the ratio of the center-to-center distance A to the outside diameter B in the first water tube array 6, A/B, is 1.4 while the ratio of the interval E of the burning-reaction continuing zone 13 to the outside diameter B, E/B, is 1.2.

Next, the second water tube array 8 of a tenth embodiment as shown in FIG. 11 is formed by arranging a plurality of heat-recovery water tubes 7 into two annular water tube arrays. In the inner array of this second water tube array 8, gaps between adjacent heat-recovery water tubes 7 are blocked by plate-shaped inner-array fin members 19. Then, at a circumferential portion of the inner array, there is provided an inner-array opening 20 which communicates inner circumferential side and outer circumferential side of the inner array with each other. Also, in the outer array of the second water tube array 8, gaps between adjacent heat-recovery water tubes 7 are blocked by plate-shaped outer-array fin members 21. Then, at a circumferential portion of the outer array, there is provided an outer-array opening 22 which communicates inner circumferential side and outer circumferential side of the outer array with each other. Then, the inner-array opening 20 and the outer-array opening 22 are placed so as to be shifted circumferentially of the second water tube array 8 so that high-temperature gas will not go out directly from the inner-array opening 20 to the outer-array opening 22. In this tenth embodiment, the outer-array opening 22 is placed with a phase shift of approximately 180° with respect to the inner-array opening 20. Further, between the inner array and the outer array of the second water tube array 8, there is formed an annular gas flow path 23 which communicates the inner-array opening 20 and the outer-array opening 22 with each other. In this case, the inner-array opening 20 and the outer-array opening 22 are formed by cutting out corresponding portions of the heat-recovery water tubes 7, the inner-array fin members 19 or the outer-array fin members 21. In addition, in the tenth embodiment, the ratio of the center-to-center distance A to the outside diameter B in the first water tube array 6, A/B, is 1.4 while the ratio of the interval E of the burning-reaction continuing zone 13 to the outside diameter B, E/B, is 1.2.

In this tenth embodiment, burning-reaction ongoing gas that has flowed out from the gaps 12 of the first water tube array 6 nearly completes the burning reaction before reaching the second water tube array 8, thus resulting in a high-temperature gas with the flame extinguished. Then, after flowing along the circumference of the inner array of the second water tube array 8, the gas flows into the inner-array opening 20. The burning-reaction ongoing gas and the burning-reaction completed gas that have flowed through the inner-array opening 20 into the gas flow path 23 are diverged into opposite two ways, flowing within the gas flow path 23, joining together at the outer-array opening 22. During this process, the burning-reaction completed gas exerts heat recovery with the heat-recovery water tubes 7 confronting the gas flow path 23. That is, the arrangement that water tube arrays arranged into a nearly C-shape are combined so as to be doubled and opposite in direction, as in this tenth embodiment, allows the contact heat transfer surfaces to be widened so that the amount of contact heat transfer in the second water tube array 8 is increased.

The inner array and the outer array of the second water tube array 8, although having been arranged into a nearly concentric configuration in this tenth embodiment, may instead be arranged so as to be eccentric. The direction of eccentricity in this case is preferably such that the radial distance between the inner array and the outer array becomes smaller on the outer-array opening 22 side. The reason of this is as follows. That is, the temperature of the burning-reaction completed gas that passes through the gas flow path 23 lowers due to the heat transfer with the second water tube array 8 to more extent as it is closer to the outer-array opening 22. For this reason, by narrowing the radial distance between the outer array and the inner array, the flow rate of the burning-reaction completed gas can be enhanced and besides the amount of contact heat transfer can be increased.

To add a further explanation, the arrangement of the second water tube array 8 is not limited to such arrangements as shown in the above eighth to tenth embodiments. These arrangements may be combined in appropriate ways as required, or the width F of the second gaps 14 between adjacent heat-recovery water tubes 7 may be changed, so that the amount of heat recovery can be increased. For example, whereas the same width F of the second gaps 14 has been employed in all cases of the eighth to tenth embodiments, the heat-recovery water tubes 7 may also be placed so that places with different widths F of the second gaps 14 are involved depending on the circumstances of the embodiment.

When the second water tube array 8 is formed into a multi-array annular shape, it is not necessary for these arrays to be all of coaxial or concentric arrangement. Further, this second water tube array 8 does not need to be coaxial or concentric with the first water tube array 6, but may be arranged so as to be eccentric. For example, as in the tenth embodiment, which is equipped with the first water tube array 6 and the second water tube array 8, the first water tube array 6 and the second water tube array 8 are arranged in such a way that the closer to the inner-array opening 20 it is, the narrower the radial distance between the first water tube array 6 and the second water tube array 8 becomes. With this arrangement, the farther from the inner-array opening 20 it is, the wider the distance to the second water tube array 8 is, with the result that the pressure loss of the burning-reaction ongoing gas that passes through the gaps 12 is reduced. Therefore, the burning-reaction ongoing gas will easily flow outside of the first water tube array 6 also through the gaps 12 on a side farther from the inner-array opening 20, so that the burning-reaction ongoing gas can be flowed out uniformly through the gaps 12 of the first water tube array 6.

In the above embodiments, the ratio of the center-to-center distance A to the outside diameter B of adjacent water tubes 5, A/B, has been set to a range of $1 \leqq A/B \leqq 2$. However, for the water-tube boilers according to the present invention, the ratio A/B may be set within a range of $1 \leqq A/B \leqq 3$, depending on the degree of demand for $NO_x$ reduction. Further, the ratio A/B may be selected from within a range of $1 \leqq A/B \leqq 5$. Furthermore, in the water-tube boilers according to the present invention, the ratio of the interval E of the burning-reaction continuing zone 13 to the outside diameter B, E/B, is preferably within a range of $0.5 \leqq E/B \leqq 6$, but may be selected from within a range of $1 \leqq E/B \leqq 15$, depending on the degree of demand for CO reduction.

Furthermore, the water-tube boilers according to the present invention are not limited to those in which the combustion equipment 10 is fitted to the upper header 2, and include those in which the combustion equipment 10 is fitted to the lower header 3. The combustion equipment 10, in turn, is not limited to combustion equipment of any specific type, but may be combustion equipment of various types. For example, the combustion equipment 10 may be premix combustion equipment or diffused-combustion type combustion equipment or other various types of combustion equipment such as vaporizing combustion type combustion equipment. Besides, the fuel to be used for the combustion equipment may be selected, whether liquid or gas. In particular, the diffused-combustion type combustion equipment needs a zone where fuel (whether liquid or gas) and combustion-air are mixed in the downstream of the combustion equipment to start the burning reaction (hereinafter, referred to as "initial burning reaction zone"). In the water-tube boilers according to the present invention, the combustion equipment 10 is inserted through one opening of the first water tube array 6 with their axes aligned, where a space surrounded by the first water tube array 6 and having no water tubes 5 present on its inner circumferential side is present on the downstream side of the combustion equipment 10 in the direction of the axis 11. This space is ensured as the initial burning reaction zone. In particular, combustion equipment which use liquid fuel are, in most cases, of the diffused-combustion type, and water-tube boilers using such combustion equipment is enabled to effectively achieve the $NO_x$ reduction without impeding the mixing and burning reaction of fuel and combustion-air.

As described hereinabove, according to the present invention, there can be provided a water-tube boiler which can fulfill further reduction in $NO_x$, and which can achieve both $NO_x$ reduction and CO reduction at the same time, with a simple constitution implemented by devised arrangement of water tubes, and which produces clean exhaust gas to meet environmental problems.

What is claimed is:

1. A water-tube boiler comprising:

a combustion chamber where a combustion reaction takes place;

a plurality of water tubes arranged in a part of said combustion chamber where the combustion reaction takes place so as to extend along the same direction in an annular shape, said plurality of water tubes having a plurality of gaps between at least some of said water tubes through which a flame associated with the combustion reaction passes;

wherein said water tubes are constructed and arranged so that a temperature of the flame after contacting said water tubes is lowered to below 1400° C., whereby generation of NOx is reduced compared to generation of NOx at a temperature greater than 1400° C.

2. The water-tube boiler according to claim 1, further comprising heat-recovery water tubes arranged outside said plurality of water tubes in an annular shape.

3. The boiler according to claim 1, wherein said water tubes are constructed and arranged so that a temperature of said flame after contacting said water tubes is lowered to between 800° C. and 1400° C.

4. The boiler according to claim 1, wherein said water tubes are constructed and arranged so that a temperature of said flame after contacting said water tubes is lowered to between 900° C. and 1300° C.

5. The water-tube boiler according to claim 1, wherein some of said water tubes are arranged so as to be gathered in close contact with one another.

6. The water-tube boiler according to claim 1, wherein said plurality of water tubes are arranged so as to include gaps having different widths.

7. The water-tube boiler according to claim 1, wherein said plurality of water tubes comprises at least two arrays of water tubes.

8. The water-tube boiler according to claim 1, wherein said plurality of water tubes are one of tilted relative to vertical and bent.

9. A water-tube boiler comprising:

a combustion chamber where a combustion reaction takes place;

a first water tube array including a plurality of first water tubes arranged in said combustion chamber so as to extend along the same direction in an annular shape, said first water tubes having a plurality of gaps between at least some of said water tubes through which a flame associated with the combustion reaction passes, wherein said first water tubes are constructed and arranged within the combustion chamber so that a temperature of the flame after contacting said first water tubes is lowered to below 1400° C., whereby generation of NOx is reduced compared to generation of NOx at a temperature greater than 1400° C.; and a zone radially outside of said first water tube array in which at least part of the combustion reaction takes place.

10. The water-tube boiler according to claim 9, further comprising heat-recovery water tubes arranged outside said plurality of first water tubes in an annular shape.

11. The boiler according to claim 9, wherein said water tubes are constructed and arranged so that a temperature of said flame after contacting said water tubes is lowered to between 800° C. and 1400° C.

12. The boiler according to claim 9, wherein said water tubes are constructed and arranged so that a temperature of said flame after contacting said water tubes is lowered to between 900° C. and 1300° C.

13. The water-tube boiler according to claim 9, wherein said first water tube array comprises a plurality of water tube arrays.

14. The water-tube boiler according to claim 13, further comprising a plurality of heat-recovery water tubes arranged outside said first water tube array.

15. The water-tube boiler according to claim 14, wherein some of said heat-recovery water tubes are arranged so as to be gathered in close contact with one another.

16. The water-tube boiler according to claim 14, wherein said heat-recovery water tubes have gaps of different widths therebetween.

17. The water-tube boiler according to claim 14, wherein the plurality of heat-recovery water tubes are arranged in an annular second water tube array.

18. The water-tube boiler according to claim 17, wherein said second water tube array comprises a plurality of annular water tube arrays.

19. The water-tube boiler according to claim 18, wherein said second water tube array includes an inner-array opening provided in an inner array of said second water tuber array communicating an inner circumferential side and an outer circumferential side of said inner array with each other, and an outer-array opening provided in an outer array of said second water tube array communicating an inner circumferential side and outer circumferential side of said outer array with each other, wherein said inner-array opening and said outer-array opening are arranged so as to be on diametrically opposite sides of said second water tube array.

20. A water-tube boiler comprising:

first and second spaced apart headers;

a plurality of first water tubes in fluid communication with said first and second headers and being arranged generally along a first annulus, at least some of said first water tubes being spaced apart from one another so as to provide gaps therebetween;

a combustion device constructed and arranged within said first annulus to emit a flame therefrom, wherein said gaps allow the flame associated with a combustion reaction to pass therebetween, wherein said first water tubes are constructed and arranged so that a temperature of the flame after contacting said first water tubes is lowered to below 1400° C. whereby generation of NOx is reduced compared to generation of NOx at a temperature greater than 1400° C.; and a plurality of second water tubes in fluid communication with said first and second headers and being arranged generally on a second annulus lying outside of said first annulus;

wherein said pluralities of first and second water tubes have at least one spacing therebetween.

21. The water tube boiler of claim 20, wherein said pluralities of first and second water tubes each have a plurality of spacings therebetween.

22. The water tube boiler of claim 21, wherein said plurality of first water tubes are tilted relative to vertical, whereby said pluralities of first and second water tubes have a plurality of spacings therebetween.

23. The water tube boiler of claim 22, wherein some of said plurality of first water tubes are arranged in contact with each other in groups to form a plurality of spaced apart groups of first water tubes arranged on generally along said first annulus.

24. The water tube boiler of claim 22, wherein some of said plurality of first water tubes are arranged in contact with each other in groups to form a plurality of spaced apart groups of first water tubes arranged on generally along said first annulus, and wherein some of said plurality of second water tubes are arranged in contact with each other in groups to form a plurality of spaced apart groups of second water tubes arranged on generally along said second annulus.

25. The water tube boiler of claim 21, wherein said first water tubes are bent inwardly along a direction from said first header to said second header, whereby a portion of said plurality of first water tubes adjacent to said second header is spaced farther from said plurality of second water tubes than another portion of said plurality of first water tubes adjacent said first header.

26. The water tube boiler of claim 25, wherein some of said plurality of first water tubes are arranged in contact with each other in groups to form a plurality of spaced apart groups of first water tubes arranged on generally along said first annulus.

27. The water tube boiler of claim 25, wherein some of said plurality of first water tubes are arranged in contact with each other in groups to form a plurality of spaced apart groups of first water tubes arranged on generally along said first annulus, and wherein some of said plurality of second water tubes are arranged in contact with each other in groups to form a plurality of spaced apart groups of second water tubes arranged on generally along said second annulus.

28. The water tube boiler of claim 21, wherein said first water tubes are bent such that an intermediate portion of said first water tubes is spaced farther from said plurality of second water tubes than end portions of said first water tubes adjacent said first and second headers, respectively.

29. The water tube boiler of claim 28, wherein some of said plurality of first water tubes are arranged in contact with each other in groups to form a plurality of spaced apart groups of first water tubes arranged on generally along said first annulus.

30. The water tube boiler of claim 28, wherein some of said plurality of first water tubes are arranged in contact with each other in groups to form a plurality of spaced apart groups of first water tubes arranged on generally along said first annulus, and wherein some of said plurality of second water tubes are arranged in contact with each other in groups to form a plurality of spaced apart groups of second water tubes arranged on generally along said second annulus.

31. The water tube boiler of claim 20, wherein some of said plurality of first water tubes are arranged in contact with each other in groups to form a plurality of spaced apart groups of first water tubes arranged on generally along said first annulus.

32. The water tube boiler of claim 31, wherein some of said plurality of second water tubes are arranged in contact with each other in groups to form a plurality of spaced apart groups of second water tubes arranged on generally along said second annulus.

33. The water tube boiler of claim 20, wherein some of said plurality of second water tubes are arranged in contact with each other in groups to form a plurality of spaced apart groups of second water tubes arranged on generally along said second annulus.

34. The water tube boiler of claim 20, wherein said first water tubes are arranged to be radially inwardly offset and radially outwardly offset from said first annulus in an alternating fashion.

35. The water tube boiler of claim 20, wherein said first water tubes are arranged in inner and outer annular arrays along said first annulus.

36. The water tube boiler of claim 20, wherein said second water tubes are arranged in inner and outer annular arrays along said second annulus.

37. The water tube boiler of claim 20, wherein said second water tubes are arranged in inner and outer annular arrays along said second annulus, wherein every pair of said second water tubes in said inner and outer annular arrays except one, respectively, are joined by a fin member therebetween, a gap in said inner annular array between said pair of second water tubes not joined by a fin member and a gap in said outer annular array between said pair of second water tubes not joined by a fin member are arranged to be spaced apart by 180 degrees.

38. In a boiler including a burner constructed and arranged to emit flame and a plurality of water tubes extending in the same general direction in an annular shape about the burner, at least some of the water tubes having gaps between themselves, a method of operating the boiler so as to reduce generation of thermal NOx, comprising:

locating the water tubes sufficiently close to the burner such that a flame from the burner passes through the gaps between the water tubes;

firing the burner so as to emit a flame having a first temperature above 1400° C.; and passing the flame through the gaps between the water tubes so as to reduce the flame temperature to a second temperature below 1400° C., thereby reducing generation of thermal NOx.

39. The method according to claim 38, wherein said first temperature is between 1700° C. and 1800° C.

40. The method according to claim 38, wherein said second temperature is between 800° C. and 1400° C.

41. The method according to claim 40, wherein said second temperature is between 900° C. and 1300° C.

* * * * *